US008820913B2

(12) United States Patent
Koase et al.

(10) Patent No.: US 8,820,913 B2
(45) Date of Patent: Sep. 2, 2014

(54) LIQUID EJECTION APPARATUS

(75) Inventors: Takashi Koase, Shiojiri (JP); Yoichi Kobayashi, Matsumoto (JP); Tsuneyuki Sasaki, Matsumoto (JP); Masako Fukuda, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 86 days.

(21) Appl. No.: 13/409,481

(22) Filed: Mar. 1, 2012

(65) Prior Publication Data

US 2012/0224005 A1 Sep. 6, 2012

(30) Foreign Application Priority Data

Mar. 3, 2011 (JP) ..... 2011-046433

(51) Int. Cl.
*B41J 2/01* (2006.01)
*B41J 11/00* (2006.01)

(52) U.S. Cl.
CPC ..... *B41J 11/002* (2013.01)
USPC ..... 347/102

(58) Field of Classification Search
CPC ..... B41J 11/002
USPC ..... 347/101, 102, 51; 346/25; 219/216
See application file for complete search history.

(56) References Cited

U.S. PATENT DOCUMENTS 5,329,295 A * 7/1994 Medin et al. ..... 347/102
5,373,312 A * 12/1994 Fujioka et al. ..... 347/102
5,528,271 A * 6/1996 Ebisawa ..... 347/34
5,589,866 A * 12/1996 Russell et al. ..... 347/102
5,646,668 A * 7/1997 Fujioka et al. ..... 347/104
5,771,054 A * 6/1998 Dudek et al. ..... 347/102
5,786,835 A * 7/1998 Ikeda et al. ..... 347/106
6,367,906 B1 * 4/2002 Hiramatsu et al. ..... 347/34
6,390,618 B1 * 5/2002 Wotton et al. ..... 347/102
6,439,712 B1 * 8/2002 Mizutani et al. ..... 347/102
6,463,674 B1 * 10/2002 Meyers et al. ..... 34/304
6,877,852 B2 * 4/2005 Hay et al. ..... 347/102
6,945,628 B2 * 9/2005 Koitabashi et al. ..... 347/34
7,052,124 B2 * 5/2006 Pickup ..... 347/102
7,300,129 B2 * 11/2007 Kumamoto et al. ..... 347/16
7,500,745 B2 * 3/2009 Ushirogouchi et al. ..... 347/102
7,712,889 B2 * 5/2010 Inoue ..... 347/102
7,794,076 B2 * 9/2010 Nakano et al. ..... 347/102

(Continued)

FOREIGN PATENT DOCUMENTS

JP 08-323977 12/1996
JP 2001-191507 7/2001
JP 2002-347226 12/2002

*Primary Examiner* — Mathew Luu
*Assistant Examiner* — Patrick King
(74) *Attorney, Agent, or Firm* — Workman Nydegger

(57) ABSTRACT

There is provided a liquid ejection apparatus in which convection generated by a convection generation unit does not give an influence on an irradiation unit, ink can be heated and dried sufficiently, and bleeding can be suppressed from occurring. The liquid ejection apparatus includes a head unit which has a nozzle for ejecting liquid onto a recording medium, a carriage which makes the head unit relatively scan the recording medium, an infrared ray irradiation unit which is provided at a vertically upper side of the carriage in a scanning direction of the carriage and irradiates the recording medium with infrared rays, a convection generation unit which is provided at a vertically upper side of the carriage in the scanning direction of the carriage and generates convection on the recording medium, and a separation wall which is provided between the infrared ray irradiation unit and the convection generation unit.

9 Claims, 6 Drawing Sheets

(56) References Cited

U.S. PATENT DOCUMENTS 7,862,163 B2 * 1/2011 Maeno et al. ..... 347/100
8,308,284 B2 * 11/2012 Kanada ..... 347/102
2004/0017453 A1 * 1/2004 Hay et al. ..... 347/102
2010/0149297 A1 * 6/2010 Kanada ..... 347/102
2011/0050824 A1 * 3/2011 Toya et al. ..... 347/102
2011/0096132 A1 * 4/2011 Kobayashi et al. ..... 347/102

* cited by examiner

LIQUID EJECTION APPARATUS

INCORPORATION BY REFERENCE

This application claims the benefit of Japanese Patent Application No. 2011-046433, filed on Mar. 3, 2011, which is hereby incorporated by reference in its entirety.

BACKGROUND

1. Technical Field

The present invention relates to a liquid ejection apparatus which ejects liquid onto a liquid ejection surface of an ejection target.

2. Related Art

As a liquid ejection apparatus which ejects liquid onto a target, an ink jet recording apparatus which ejects ink onto a recording medium so as to perform printing has been known. In order to obtain a high-quality image without bleeding with such ink jet recording apparatus, solvent in ink is required to be diffused into the air quickly after the ink has been ejected and has landed onto a recording medium.

As a method of diffusing solvent as described above, a method by heating a recording medium onto which ink has landed or a method by blowing air onto the recording medium has been proposed. For example, a configuration of an ink jet printer using an ink drying method has been disclosed in JP-A-2002-347226. In the ink drying method, a rear surface of a recording medium is heated at a downstream side and an upstream side in a recording medium transportation direction of a line head and a recording surface thereof is heated and dried in a non-contact manner at the downstream side of the line head.

Further, a configuration of an ink jet printer in which a drum for holding and transporting a recording medium is formed by a heating drum has been proposed in JP-A-8-323977.

In addition, a print apparatus which prevents bleeding of a printed matter from occurring by drying a recording medium with an infrared ray irradiation light source and a blower in ink jet printing has been disclosed in JP-A-2001-191507.

As described in JP-A-2001-191507, when the infrared ray irradiation light source and the blower (convection generation unit) are provided on a serial-type printer 10, they can be arranged in a layout as illustrated in FIG. 7 and FIG. 8, for example. FIG. 7 is a side view illustrating an existing liquid ejection apparatus (printer). Further, FIG. 8 is a view schematically illustrating a direction of the air blown from a convection generation unit 170 in the existing liquid ejection apparatus (printer).

In FIG. 7 and FIG. 8, an infrared ray irradiation unit 160 is constituted by an infrared ray irradiation light source 161, a reflector 162, and the like. The infrared ray irradiation light source 161 is arranged in a width direction (first direction) of a recording medium S. The reflector 162 reflects light emitted from the infrared ray irradiation light source 161. The infrared ray irradiation unit 160 irradiates infrared rays onto landed ink to heat the ink so as to accelerate diffusion of solvent in the ink.

Further, the convection generation unit 170 blows air onto the recording medium S onto which ink has landed over the width direction (first direction) of the recording medium S. The convection generation unit 170 is constituted by a plurality of fans 171, an air guide member 172, and an air port portion 173. The plurality of fans 171 are provided so as to be aligned in the first direction. The air guide member 172 guides the direction of the convection generated with rotation of the fans 171. The air port portion 173 blows air guided by the air guide member 172 onto the recording medium S.

A carriage 14 ejects ink from a built-in head while reciprocating along a guide rail 12 provided in the width direction of the recording medium so as to perform printing on the recording medium. The convection generation unit 170 is provided at an upper side of the carriage 14 in a vertical direction. With this, the convection generation unit 170 blows air onto the recording medium S so as to diffuse volatile components quickly from the landed ink.

In the above printer according to an existing example, air blown from the convection generation unit 170 hits an upper surface portion of the carriage 14 at a place where the carriage 14 is located in the first direction so that a direction of the air is changed. Therefore, the air hits the infrared ray irradiation unit 160 so as to cool the infrared ray irradiation light source 161. An infrared radiation ability of the infrared ray irradiation light source 161 is proportional to the fourth power of a temperature thereof. Therefore, if the temperature of the infrared ray irradiation light source 161 is lowered due to the air which hits thereto, a heating ability thereof is largely lowered. As a result, landed ink cannot be heated and dried sufficiently. There arises a problem in that bleeding is generated so as to deteriorate image quality.

SUMMARY

An advantage of some aspects of the invention is to provide the following liquid ejection apparatus.

A liquid ejection apparatus according to an aspect of the invention includes a liquid ejection head which has a nozzle for ejecting liquid onto a recording medium, a carriage which holds the liquid ejection head and makes the liquid ejection head relatively scan the recording medium, an irradiation unit which is provided at a vertically upper side of the carriage in a scanning direction of the carriage and irradiates the recording medium with infrared rays, a convection generation unit which is provided at a vertically upper side of the carriage in the scanning direction of the carriage and generates convection on the recording medium, and a separation wall which is provided between the irradiation unit and the convection generation unit.

In the liquid ejection apparatus according to the aspect of the invention, it is preferable that the separation wall be provided integrally with the carriage.

Further, in the liquid ejection apparatus according to the aspect of the invention, it is preferable that the separation wall be provided in the scanning direction of the carriage.

Further, in the liquid ejection apparatus according to the aspect of the invention, it is preferable that the convection generation unit generate convection to apply a positive pressure onto the recording medium.

Further, in the liquid ejection apparatus according to the aspect of the invention, it is preferable that the convection generation unit generate convection which applies a negative pressure onto the recording medium.

Further, in the liquid ejection apparatus according to the aspect of the invention, it is preferable that the carriage and the separation wall have surface layers which reflect infrared rays.

As described above, in the liquid ejection apparatus according to the aspect of the invention, the separation wall is provided between the irradiation unit and the convection generation unit. With the liquid ejection apparatus according to the invention, air which has hit an upper surface portion of the carriage at a place where the carriage is located in the first direction is shielded by the separation wall so as not to hit the irradiation unit. Therefore, convection generated by the convection generation unit does not give an influence on the irradiation unit. Accordingly, a heating ability of the irradiation unit is not lowered so that the landed ink can be heated and dried sufficiently. This makes it possible to suppress bleeding from occurring and realize high image quality.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
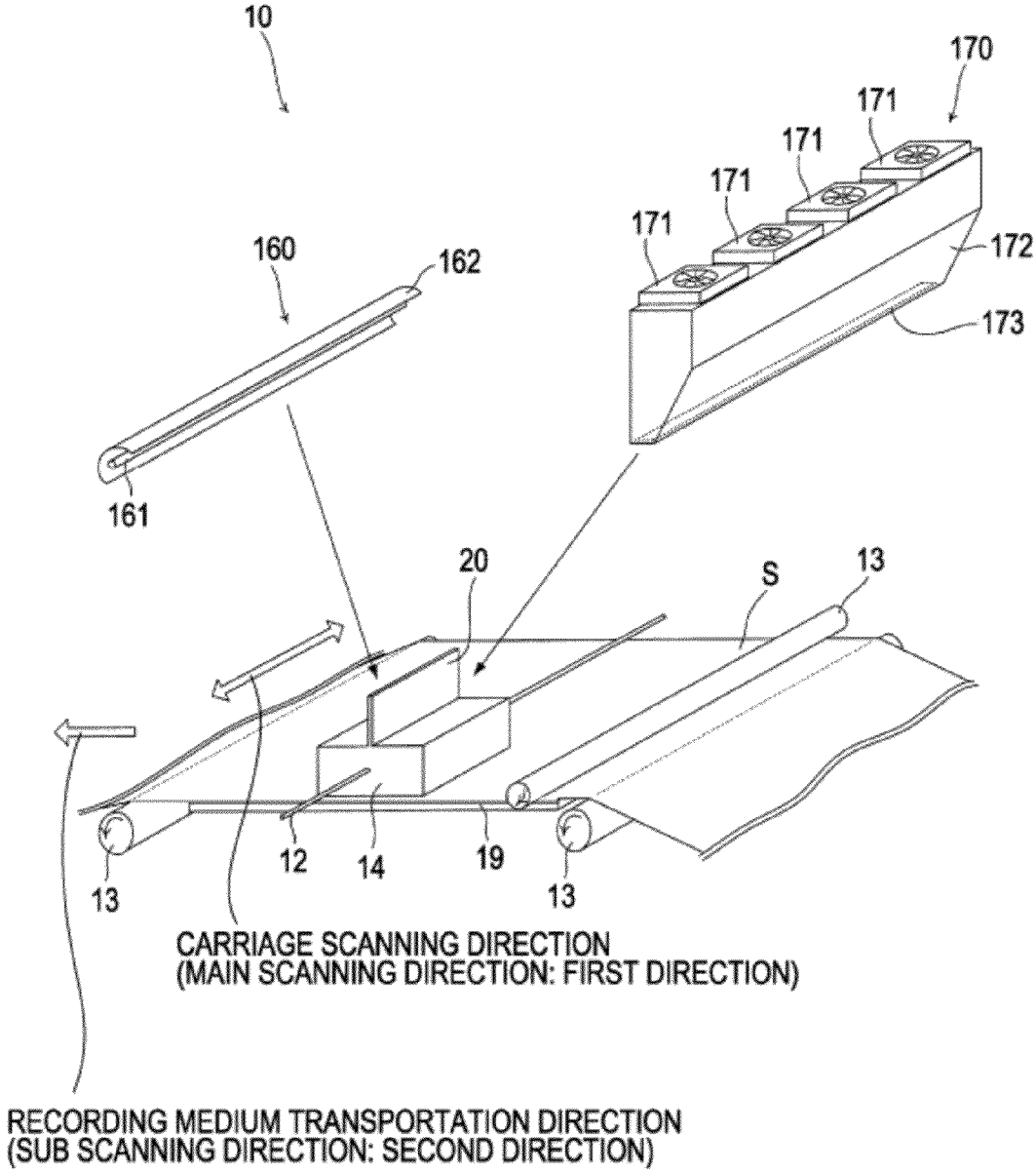
FIG. 1 is an exploded view illustrating a printer as an example of a liquid ejection apparatus according to an embodiment of the invention.
Figure 2:
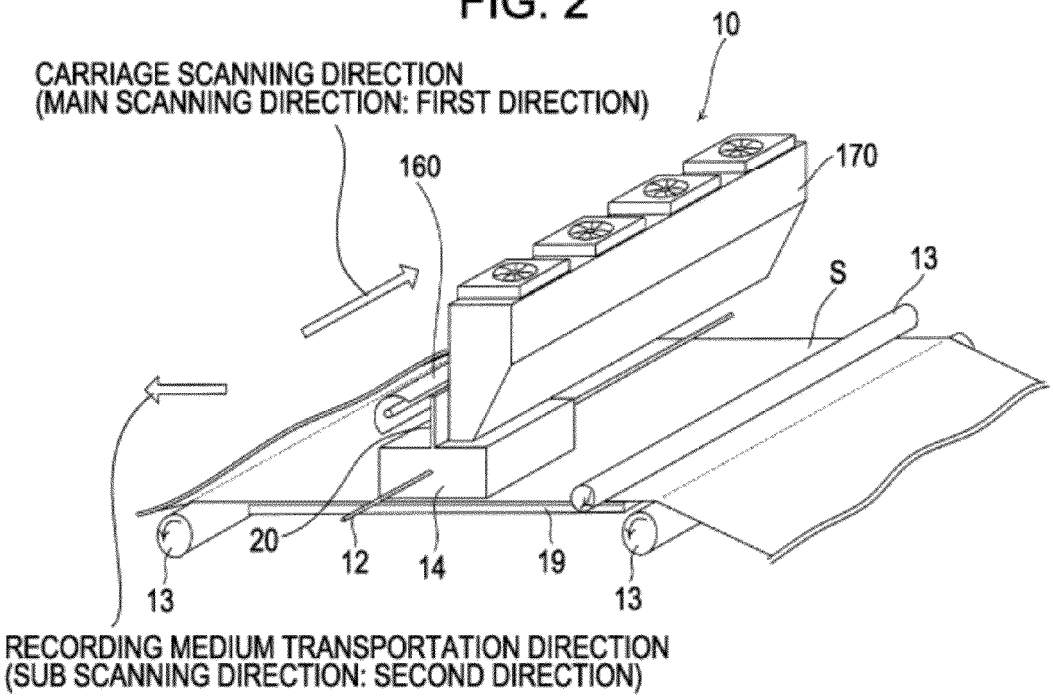
FIG. 2 is a view illustrating an outline of the printer as the example of the liquid ejection apparatus according to the embodiment of the invention.
Figure 3:
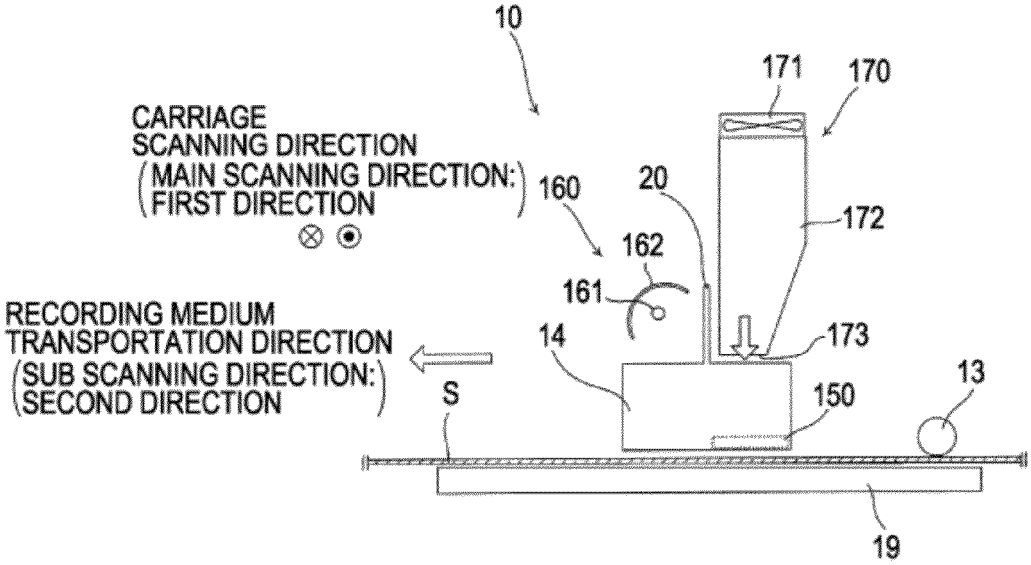
FIG. 3 is a side view schematically illustrating a side surface of the printer as the example of the liquid ejection apparatus according to the embodiment of the invention.
Figure 4:
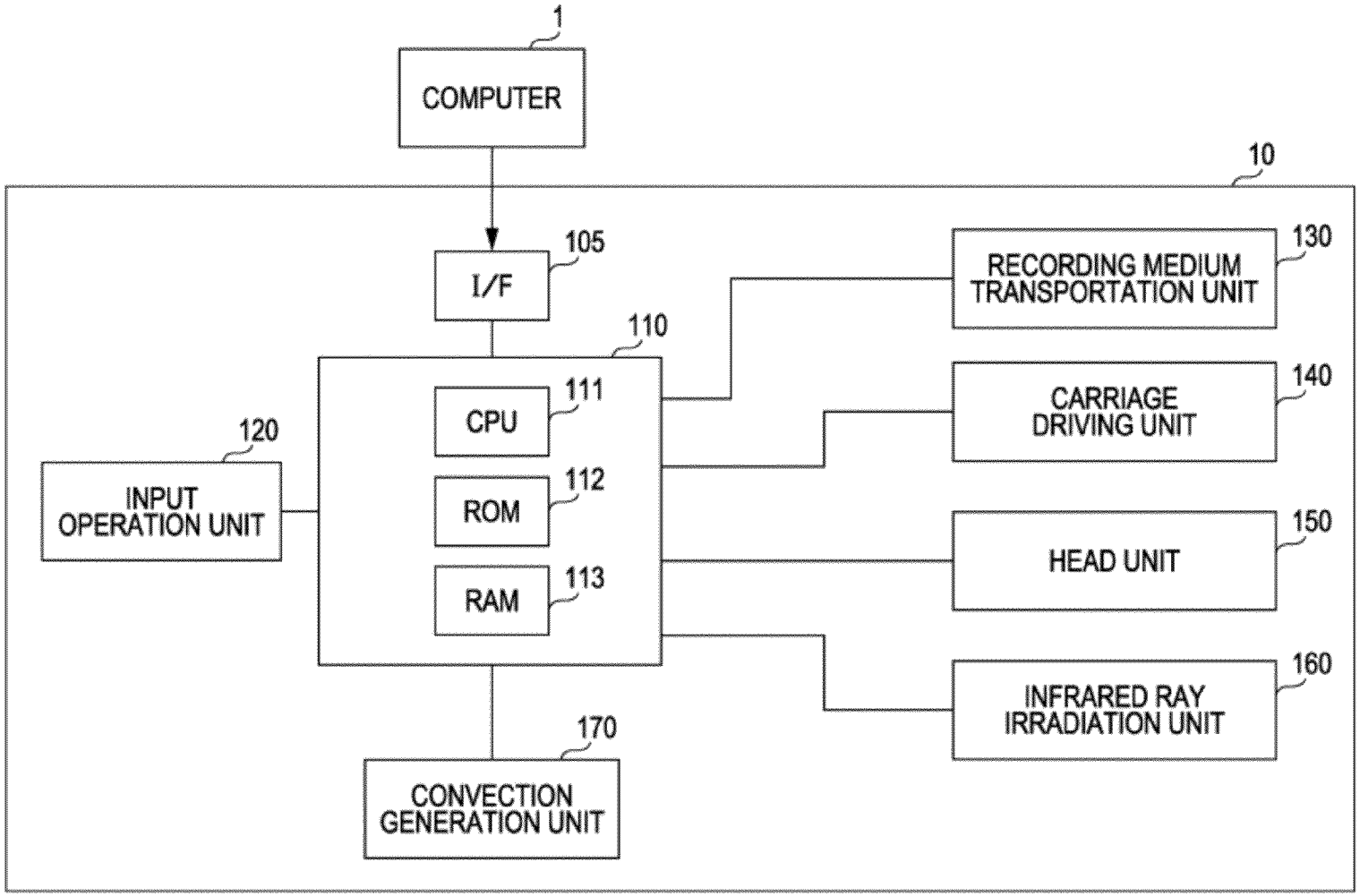
FIG. 4 is a block diagram illustrating the entire configuration of the printer.

Hereinafter, an embodiment of the invention is described with reference to drawings. FIG. 1 is an exploded view illustrating a printer 10 as an example of a liquid ejection apparatus according to an embodiment of the invention. FIG. 2 is a view illustrating an outline of the printer 10. FIG. 3 is a side view schematically illustrating a side surface of the printer 10. FIG. 4 is a block diagram illustrating the entire configuration of the printer 10.

An infrared ray irradiation unit 160 as illustrated in FIG. 1 is arranged at one side of a separation wall 20 in a scanning direction of a carriage 14 in a manner as illustrated in FIG. 2. Further, a convection generation unit 170 as illustrated in FIG. 1 is arranged at the other side of the separation wall 20 over the scanning direction of the carriage 14 in a manner as illustrated in FIG. 2. FIG. 3 is a view illustrating a state where the infrared ray irradiation unit 160 and the convection generation unit 170 are arranged at the upper side of the carriage 14 in the vertical direction when seen from the side of a side surface of the printer 10.

As illustrated in FIG. 1 and FIG. 2, the printer 10 has a bar-shaped guide rail 12 and the carriage 14 is supported on the guide rail 12. The carriage 14 reciprocates along the guide rail 12 in a main scanning direction (first direction) by a carriage driving unit 140 (see, FIG. 4) so as to scan a recording medium S.

A head unit 150 is mounted on the carriage 14. Nozzles through which inks (liquids) of colors of yellow (Y), magenta (M), cyan (C) and black (K) are ejected onto the recording medium S are formed on the head unit 150. The inks of the colors of yellow (Y), magenta (M), cyan (C) and black (K) are mainly used as inks for image recording for drawing a predetermined image based on image data received from a computer 1 or the like as a high-level apparatus. It is to be noted that hereinafter, yellow or yellow ink is abbreviated as "Y", and so on, in some case. Further, in the embodiment, an example in which inks of four colors of yellow (Y), magenta (M), cyan (C) and black (K) are used is described. However, color types and the number of colors, which can be used in the head unit 150, are not limited thereto.

The computer 1 transmits image data in accordance with an image to be printed to the printer 10 through a printer driver. Pixel data indicating whether or not ink is ejected for each color of ink for each pixel of a medium is included in the image data.

As the above ink of each color used in the embodiment, for example, ink in which pigment or dye is dispersed in water or organic solvent as solvent can be appropriately used. In addition, as the recording medium S used in the printer 10 according to the invention, various papers such as a plain paper, a recycle paper, and a glossy paper, various fabrics, various nonwoven fabrics, and a recording medium S formed by a material of resin or the like can be applied.

The above head unit 150 is connected to a controller 110 and a signal for controlling ejection of ink is transmitted to the head unit 150. A center portion of a movable range of the carriage 14 corresponds to a recording region on which recording is performed on the recording medium S. A platen 19 which horizontally supports the recording medium S from a non-recording surface side is provided on the recording region.

Further, a recording medium transportation unit 130 (see, FIG. 4) is provided on the printer 10. The recording medium transportation unit 130 is constituted by a plurality of transportation rollers 13 and the like and feeds the recording medium S in a sub scanning direction (second direction). The recording medium transportation unit 130 intermittently transports the recording medium S by repeatedly transporting the recording medium S or stopping the transportation thereof in accordance with an operation of the carriage 14 when an image is recorded.

An input operation unit 120 is provided on an upper surface (not illustrated) of a housing of the printer 10. The input operation unit 120 is formed by a touch panel, for example, and displays recording modes which can be selected by a user. A user selects and inputs a displayed recording mode on the input operation unit 120. The input operation unit 120 is connected to the controller 110, which will be described later, and outputs a signal relating to the recording mode selected based on a predetermined operation to the controller 110.

FIG. 4 illustrates a control block for controlling the printer 10 according to the embodiment. The controller 110 in the control block is constituted by a CPU 111, a ROM 112, and a RAM 113, for example, and expands a processing program recorded in the ROM 112 in the RAM 113 so as to execute the processing program by the CPU 111. Further, an interface 105 is an interface provided for connecting the controller 110 of the printer 10 and the computer 1.

The controller 110 controls the recording medium transportation unit 130, the carriage driving unit 140, the head unit 150, the infrared ray irradiation unit 160, the convection generation unit 170, and the like based on a status such as an operation condition in accordance with the above-described processing program.

The infrared ray irradiation unit 160 is constituted by an infrared ray irradiation light source 161, a reflector 162, and the like at the upper side of the carriage 14 in the vertical direction. The infrared ray irradiation light source 161 is arranged in a width direction (first direction) of the recording medium S. The reflector 162 reflects light emitted from the infrared ray irradiation light source 161. The infrared ray irradiation unit 160 is a device which irradiates infrared rays onto ink ejected onto the recording medium S to heat the ink so as to accelerate diffusion of solvent in the ink. A light emission ratio and a light emission timing of the infrared ray irradiation light source 161 can be controlled through the control from the controller 110. With this configuration, an amount of infrared rays to be irradiated can be also changed in accordance with a type of the recording medium S or an ink type. It is preferable that light emission of the infrared ray irradiation light source 161 be basically in an ON state while ink is ejected onto the recording medium S with the head unit 150.

The convection generation unit 170 blows air onto the recording medium S on which ink has landed or sucks the recording medium S on which ink has landed in the width direction (first direction) of the recording medium S. Further, the convection generation unit 170 is constituted by a plurality of fans 171, an air guide member 172, and the like, at the upper side of the carriage 14 in the vertical direction. The plurality of fans 171 are provided so as to be aligned in the first direction. The air guide member 172 guides the direction of the convection generated with rotation of the fans 171. An air port portion 173 is provided on a bottom of the air guide member 172 and air can be blown or sucked from the air port portion 173.

The plurality of fans 171 are configured such that rotational directions thereof can be changed based on control from the controller 110. With this configuration, the convection generation unit 170 can generate convection to apply a positive pressure onto the recording medium S (that is, blow air), or generate convection to apply a negative pressure onto the recording medium S (that is, suck air).

In addition, the plurality of fans 171 are configured such that the number of rotations thereof can be adjusted based on control from the controller 110. With this configuration, a blowing amount when air is blown by the convection generation unit 170 or a suction amount when air is sucked by the convection generation unit 170 can be adjusted.

Volatile components from the ink landed onto the recording medium S are quickly diffused with the convection generated by the above convection generation unit 170. With this, solvent components can be accelerated to be volatilized from the ink.

The flat plate-like separation wall 20 is provided on an upper surface portion of the carriage 14. The separation wall 20 is provided so as to stand in the vertical direction integrally with the carriage 14. A flat plate constituting the separation wall 20 is formed in parallel with the first direction as the scanning direction of the carriage 14. The flat plate moves between the infrared ray irradiation unit 160 and the convection generation unit 170 with movement of the carriage 14. At this time, the flat plate moves such that a distance between the infrared ray irradiation unit 160 and the separation wall 20 and a distance between the convection generation unit 170 and the separation wall 20 are made constant.

Figure 5A:
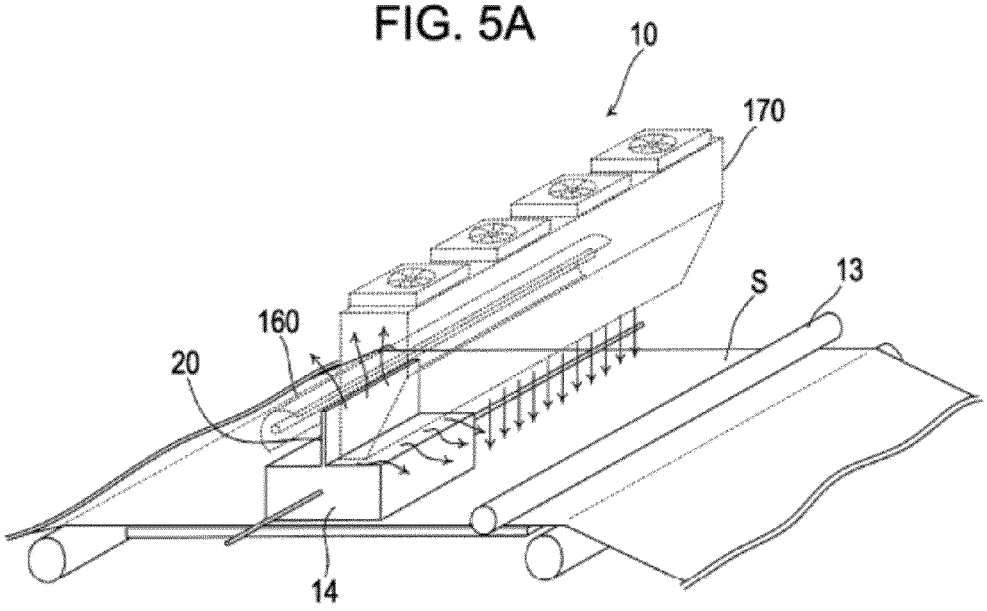
FIGS. 5A and 5B are views for explaining an effect obtained by a separation wall in the printer as the example of the liquid ejection apparatus according to the embodiment of the invention.
Figure 5B:
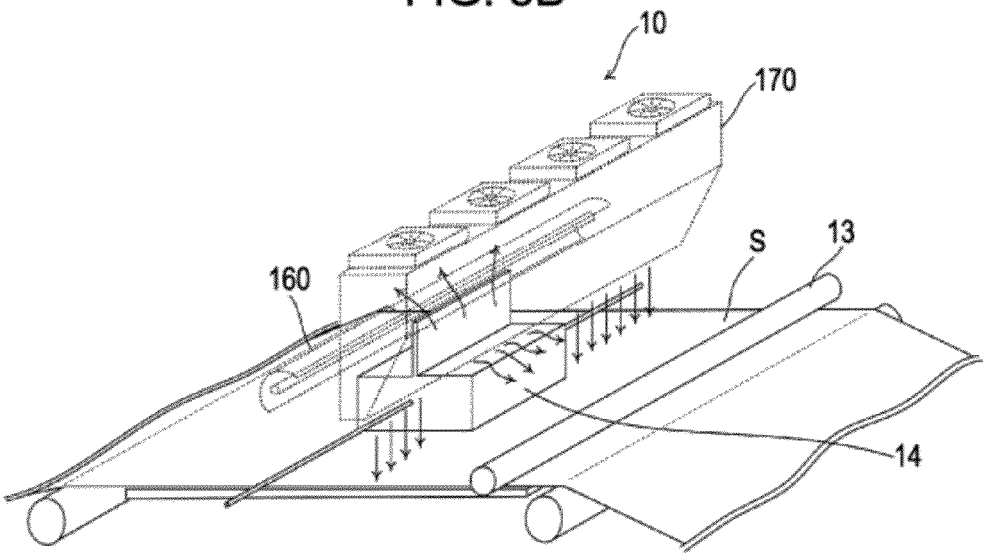

An effect obtained by the above separation wall 20 is described with reference to FIGS. 5A and 5B. FIGS. 5A and 5B are views for explaining an effect obtained by the separation wall 20 in the printer 10 as an example of the liquid ejection apparatus according to the embodiment of the invention. It is to be noted that FIGS. 5A and 5B illustrate a case where air is blown onto the recording medium S from the convection generation unit 170. Further, in FIGS. 5A and 5B, directions of the air blown from the convection generation unit 170 are schematically illustrated by arrows. In addition, note that description relating to FIGS. 5A and 5B holds true in a case where the convection generation unit 170 applies a negative pressure so as to suck the recording medium S.

FIG. 5A illustrates a state where the carriage 14 scans a predetermined position and FIG. 5B illustrates a state where the carriage 14 moves from the predetermined position and scans a position which is different therefrom.

As illustrated in FIG. 5A and FIG. 5B, the air blown from the convection generation unit 170 hits the upper surface portion of the carriage 14 regardless of a scanning position of the carriage 14 and a direction of the blown air is changed. However, the air is shielded by the separation wall 20 so that the air does not travel toward the infrared ray irradiation unit 160.

In the above liquid ejection apparatus (printer 10) according to the invention, the separation wall 20 is provided between the infrared ray irradiation unit 160 and the convection generation unit 170. With such liquid ejection apparatus (printer 10) according to the invention, air which has hit the upper surface portion of the carriage 14 at a place where the carriage 14 is located in the first direction is shielded by the separation wall 20 so as not to hit the infrared ray irradiation unit 160. Therefore, the convection generated by the convection generation unit 170 does not give an influence on the infrared ray irradiation unit 160. Accordingly, a heating ability of the infrared ray irradiation unit 160 is not lowered so that the landed ink can be heated and dried sufficiently. This makes it possible to suppress bleeding from occurring and realize high image quality.

The above separation wall 20 and the carriage 14 preferably have surface layers which reflect infrared rays irradiated from the infrared ray irradiation unit 160. Such surface layers desirably reflect equal to or larger than 80% of the infrared rays. To be more specific, this can be realized by using gold, silver, aluminum, stainless, or the like for the surface layers of the separation wall 20 and the carriage 14. The separation wall 20 and the carriage 14 include preferable infrared ray reflection surface layers so that infrared rays reflected by the separation wall 20 and the carriage 14 are irradiated onto the recording medium S therearound. Therefore, the irradiation light from the infrared ray irradiation light source 161 can be efficiently used with no waste.

Next, another embodiment of the invention is described. In the above embodiment, the separation wall 20 is provided integrally with the carriage 14. The embodiment is different from the above embodiment in a point that the separation wall 20 is provided integrally with a housing (not illustrated). Since other points in the embodiment are the same as those in the above embodiment, such different point is described, hereinafter.

Figure 6:
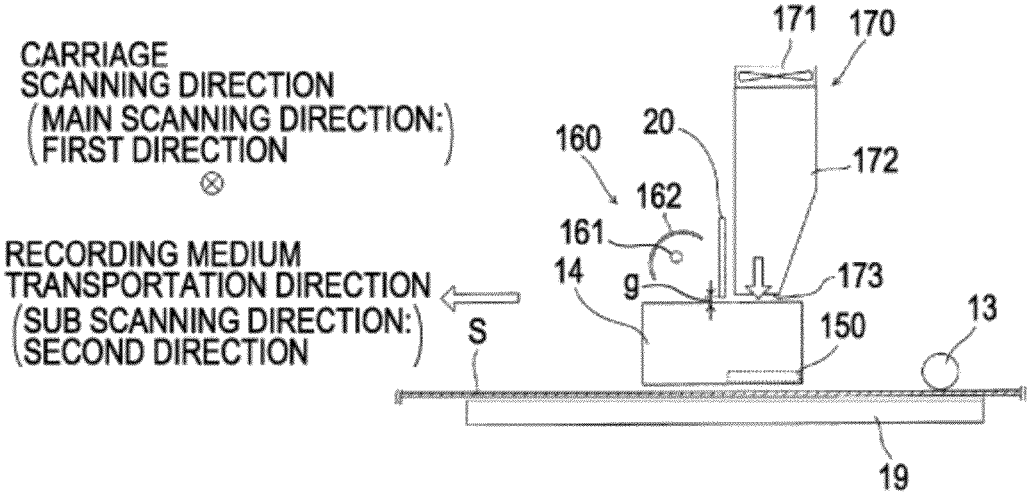
FIG. 6 is a side view schematically illustrating a side surface of a printer as an example of a liquid ejection apparatus according to another embodiment of the invention.
Figure 7:
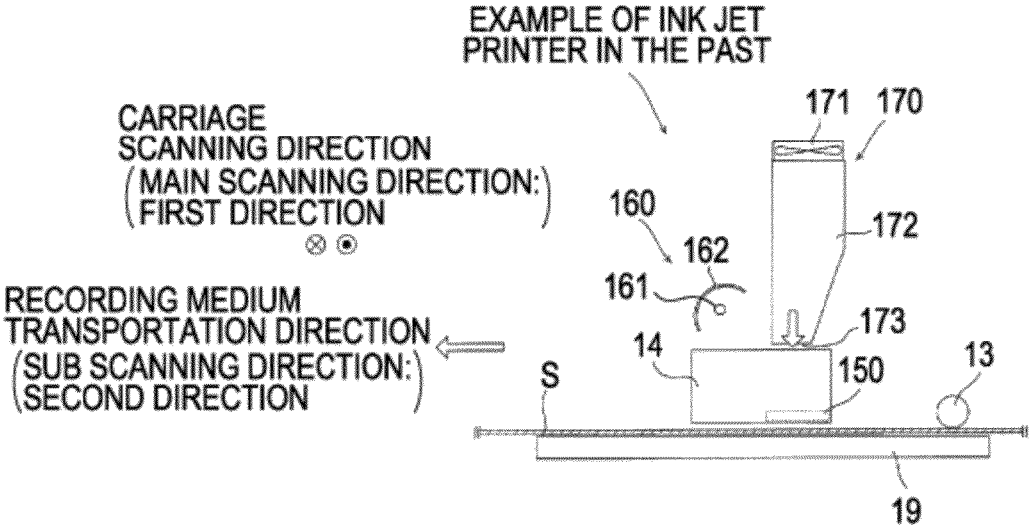
FIG. 7 is a side view illustrating an existing liquid ejection apparatus (printer).
Figure 8:
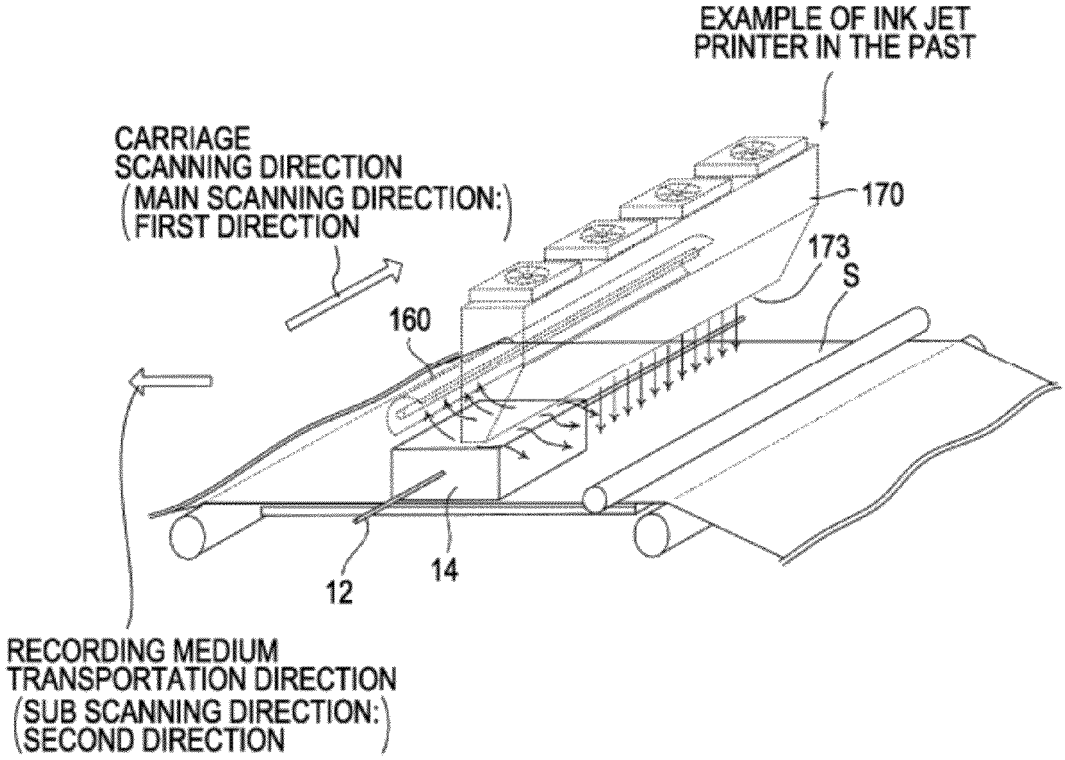
FIG. 8 is a view schematically illustrating directions of air blown from a convection generation unit in the existing liquid ejection apparatus (printer).

FIG. 6 is a side view schematically illustrating a side surface of the printer 10 as an example of a liquid ejection apparatus according to another embodiment of the invention. In the embodiment, the flat plate-like separation wall 20 is provided between the infrared ray irradiation unit 160 and the convection generation unit 170 in the first direction as the scanning direction of the carriage 14 so as to be fixed to the housing side. A gap "g" is set between the separation wall 20 and the carriage 14. With this, if the carriage 14 is moved for scanning, the carriage 14 does not collide with the separation wall 20. Further, the gap "g" is set to a slight distance to the extent that the convection by the convection generation unit 170 does not give an influence on the side of the infrared ray irradiation unit 160. In the embodiment, the same effect as that obtained in the above embodiment can be obtained.

Hereinabove, in the liquid ejection apparatus according to the invention, the separation wall is provided between the irradiation unit and the convection generation unit. With the liquid ejection apparatus, air which has hit the upper surface portion of the carriage at a place where the carriage is located in the first direction is shielded by the separation wall so as not to hit the irradiation unit. Therefore, the convection generated by the convection generation unit does not give an influence on the irradiation unit. Accordingly, a heating ability of the irradiation unit is not lowered so that the landed ink can be heated and dried sufficiently. This makes it possible to suppress bleeding from occurring and realize high image quality.

What is claimed is:

1. A liquid ejection apparatus comprising:

a liquid ejection head which has a nozzle for ejecting liquid onto a recording medium;

a carriage which holds the liquid ejection head and makes the liquid ejection head relatively scan the recording medium;

an irradiation unit which is provided at a vertically upper side of the carriage and irradiates the recording medium with infrared rays;

a convection generation unit which is provided at a vertically upper side of the carriage and generates convection on the recording medium; and a separation wall which is provided between the irradiation unit and the convection generation unit, wherein the carriage is located at a position where it is irradiated with the infrared rays irradiated from the irradiation unit.

2. The liquid ejection apparatus according to claim 1, wherein the separation wall is provided integrally with the carriage.

3. The liquid ejection apparatus according to claim 1, wherein the separation wall is provided in a scanning direction of the carriage.

4. The liquid ejection apparatus according to claim 1, wherein the convection generation unit generates convection to apply a positive pressure onto the recording medium.

5. The liquid ejection apparatus according to claim 1, wherein the convection generation unit generates convection to apply a negative pressure onto the recording medium.

6. The liquid ejection apparatus according to claim 1, wherein the carriage and the separation wall have surface layers which reflect infrared rays.

7. The liquid ejection apparatus according to claim 1, wherein the irradiation unit is located downstream of the convection generation unit in a transporting direction of the recording medium.

8. The liquid ejection apparatus according to claim 1, wherein the carriage is configured to move between the irradiation unit and the convection generation unit.

9. The liquid ejection apparatus according to claim 1, wherein the carriage is located in a position where it can be hit by air generated by the convection generation unit.

* * * * *